United States Patent [19]

Berrin et al.

[11] 4,284,970

[45] Aug. 18, 1981

[54] FABRICATION OF FILM RESISTOR CIRCUITS

[75] Inventors: Lloyd Berrin; Howard M. Cohen, both of Allentown; William B. Grupen, Emmaus; James D. McElroy, Allentown, all of Pa.

[73] Assignee: Bell Telephone Laboratories, Incorporated, Murray Hill, N.J.

[21] Appl. No.: 65,179

[22] Filed: Aug. 9, 1979

[51] Int. Cl.[3] ..... H01C 10/00

[52] U.S. Cl. ..... 338/195; 29/620; 338/308

[58] Field of Search ..... 338/195, 308–309; 29/620

[56] References Cited

U.S. PATENT DOCUMENTS

| | | | |
|---|---|---|---|
| 3,211,031 | 10/1965 | Martin | 29/620 X |
| 3,947,801 | 3/1976 | Bube | 338/195 X |

*Primary Examiner*—C. L. Albritton

*Attorney, Agent, or Firm*—Lester H. Birnbaum

[57] ABSTRACT

A method of fabricating thin and thick film resistors which results in stable resistance characteristics, ability to withstand high current or voltage and a precise method of trimming small resistors. After the resistor film (20) and contacts (22 and 23) thereto are formed, the resistors are trimmed by a cut (24) along the length dimension so that the width of the current path is reduced uniformly. The waste portion of the resistor is then separated from the circuit by a cut (27) along its width. Current crowding in the vicinity of the cut is therefore essentially eliminated.

21 Claims, 3 Drawing Figures

FABRICATION OF FILM RESISTOR CIRCUITS

BACKGROUND OF THE INVENTION

This invention relates to fabrication of film resistors and the resulting product, and in particular to a method which results in stable resistance characteristics, an ability of film resistors to withstand high current surges or voltage spikes, and precise trimming of resistors of small physical size.

Thin and thick film resistor circuits are now used in a wide variety of applications. Full use of such resistors has, however, been sometimes limited by the fact that the resistance of such elements usually has to be adjusted to a desired value by a cutting operation. Laser trimming is now a standard technique in the industry and gives adequate results for most applications. However, problems are created and explained below.

FIG. 1 illustrates a typical rectangular geometry resistor (10), with electrodes (11 and 12) making contact thereto, formed on an insulating substrate 16. The resistor has been laser-trimmed by standard techniques. The area of the trim cut is shown as 13. Current flow is illustrated as dashed lines 14. It will be noted that since the current is constrained to a narrow portion of the resistor, the current density in the vicinity of the cut, illustrated as area 15, increased. This current crowding has heretofore precluded use of film resistors which are exposed to large current surges, such as current limiting resistors exposed to lightning surges in the telephone loop plant. This effect has also caused problems where the film resistors are used as part of voltage divider networks in relay circuits. High voltages applied to the resistors in these circuits result in unacceptable resistance changes. Furthermore, even in the absence of current or voltage surges, again processes occur in the vicinity of the cut contributing to a change in resistance.

In addition to the problem of withstanding high currents or voltages, the prior art methods also limit the size of resistors which can be precisely trimmed. If too narrow a current path exists at the end of the trim cut, the resistance will drift excessively due to aging effects in the vicinity of the trim cut.

It is therefore a primary object of the invention to provide a trimming technique which permits a film resistor to withstand high currents and voltages. It is a further object of the invention to provide a technique which allows fabrication of small, precisely trimmed resistors. It is a still further object of the invention to produce resistors in general with highly stable resistances.

SUMMARY OF THE INVENTION

These and other objects are achieved in accordance with the invention. In one aspect, the invention is a method of fabricating a resistor circuit which includes the steps of forming a rectangular resistor film with electrical contacts thereto on an insulating substrate so as to establish a current path through the film when a bias is supplied to the electrodes. A desired resistance of the film is achieved by making a cut essentially in the direction of the current path to thereby define a rectangular current-carrying portion of a predetermined width and a rectangular waste portion. A cut is then made in the waste portion in a direction essentially perpendicular to the current path in order to prevent current flow therethrough.

BRIEF DESCRIPTION OF THE DRAWING

These and other features of the invention are delineated in detail in the following description. In the drawing.

DETAILED DESCRIPTION

Figure 2:
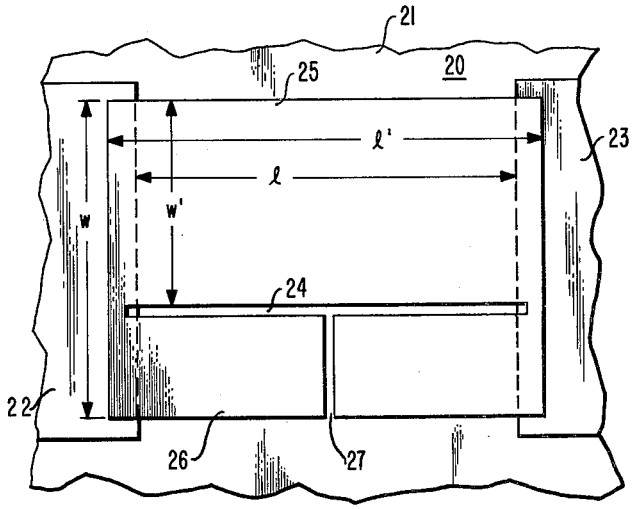
FIG. 2 is a plan view of a film resistor fabricated in accordance with one embodiment of the invention.

FIG. 2 shows one resistor incorporating some basic features of the invention. It will be realized that the resistor shown is usually one of several elements formed as part of a film circuit or hybrid integrated circuit. It will be realized also that although fabrication of a thick film resistor is described, the invention is equally applicable to fabrication of thin film resistors.

An insulating substrate, 21, was provided for support of the film circuit. The substrate was a board made of alumina, but can be any material commonly used for film circuits. A conductive layer, portions of which are shown as 22 and 23, was formed on the surface of the substrate to provide electrical interconnection and contact to the subsequently formed resistors. The conductors were formed by standard screen printing of a conductive ink selectively over the insulating substrate with gaps provided at resistor locations to establish the effective length of the resistors. In this particular example, the gap length, l, was approximately 80 mils. The particular ink used was a commercially available mixture of borosilicate glass, palladium, and silver such as the S-4000 series sold by Cermalloy or the 9843 material sold by DuPont. Any standard conductor material may be employed. The conductor was fired in accordance with standard practice by heating in air at a peak temperature of 845–855 degrees C. for 8–10 minutes and a total cycle time of 45–50 minutes. The thickness of the layer after firing was approximately 0.5 mils. In general, the thickness of the layer is preferably 0.4–0.6 mils.

The rectangular resistor, 20, was then formed by screen printing a resistor ink in accordance with standard practice in the area of the gap and slightly overlapping the conductors 22 and 23. A standard resistor ink was employed. In particular, the commercially available ink was either a mixture of borosilicate glass and ruthenium oxide such as the 800 series sold by Cermalloy or a mixture of borosilicate glass and bismuth ruthenate such as the 1400 series sold by DuPont. Again, it should be clear that the invention is applicable to any type of resistor material.

In the fabrication of current limiting resistors for use in surge protectors, the length, l′, of the resistor film as deposited was approximately 100 mils, the width, w, was approximately 120 mils and the thickness was approximately one-half mil. Of course, these dimensions can be varied widely depending on desired resistance. A preferred thickness of the film is 0.4–0.6 mils. The resistors were fired by heating in air at a peak temperature of approximately 840–860 degrees C. for approximately 8–10 minutes with a total cycle time of 45–50 minutes in accordance with standard practice. The resistance of the film after firing was typically 75 ohms. Usually, it is desirable to deposit and fire the resistor so as to give a resistance which is approximately 70–80 percent of the desired final value.

The deposition of the resistor film and the conductors establishes a current path in the film between conductors when a bias is supplied. The direction of current flow is referred to in the art as the length dimension of the resistor and the transverse direction as the width dimension regardless of which dimension is greater. This convention has been retained in this application.

The resistor was then laser trimmed in order to obtain the desired final value of resistance. The particular apparatus used was Laser Trimming System Model 20 sold by Electro Scientific Industries which included a neodinium-doped YAG laser with a 1.06 μm emission. In this particular example, the pulses had a peak amplitude of 2.4 kw, a duration of 0.15 μsec and a repetition rate of 1 kHz. The single pulse energy was approximately 350 μJ. It is known in the art that these parameters may be varied according to particular needs. it should also be realized that means other than lasers may be used to make the necessary cuts for resistor trimming.

In accordance with a basic feature of the invention, the laser cut, 24, was made essentially in the direction of the current path (i.e., in the length dimension) of the resistor. The cut extended at least across the effective length, l., of the resistor. The cut was made to define a current-carrying portion 25 having a predetermined width, w', to produce the desired resistance. In one particular example, the cut was made so that w' was approximately 90 mils to produce a resistance of approximately 100 ohms. In general, it is desirable to bring the resistance of this portion to within 2 percent of a desired final value. The portion, 26, on the other side of the cut is designated the "waste" portion since it will not perform any function in the circuit. In order to electrically isolate this portion, a second laser cut, 27, was made in the waste portion along a direction essentially perpendicular to the current path (i.e., in the width dimension) extending from the first cut, 24, to the edge of the film. This cut prevents current flow between the conductors in this portion of the film.

Although only one cut is shown in the length and width dimensions, it should be clear that several cuts may be made. Thus, several lengthwise cuts may be made to successively narrow the width of the current-carrying portion and achieve greater precision in reaching the desired final resistance. The lengthwise cuts may be overlapped for further precision. Also, if small discontinuities in the current path are not objectionable, the final cut need not extend entirely across the resistor length. If desired, the waste material can be separated by several cuts in the width dimension at various locations along the length to reduce the electric field across each cut during device operation.

It will be realized that trimming of the resistor in accordance with the invention results in a current-carrying portion of essentially uniform width and thus current crowding and aging effects in the vicinity of the cut are essentially eliminated. Thus, the resistors will have a greater ability to withstand high current surges and high voltages than previously possible.

Figure 1:
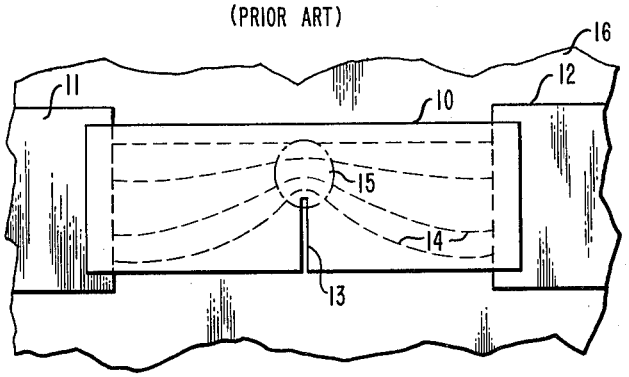
FIG. 1 (PRIOR ART)
FIG. 1 is a plan view, partly schematic, of a film resistor fabricated in accordance with a prior art process.

This was confirmed by the fabrication of several current-limiting resistors in accordance with the above technique. Simulated lightning surges were applied to resistors trimmed in accordance with the invention and to resistors trimmed according to the prior art technique illustrated in FIG. 1. The lightning surges were simulated by voltage pulses with a linear rise to a maximum of 250 volts in 10 microseconds followed by an exponential decay to half value in 1000 microseconds. The resistors trimmed in accordance with the invention survived the 100 surges applied and exhibited a small change in resistance (less than 0.25 percent). The resistors trimmed in accordance with the prior art failed after a few surges. In general, it is desirable to produce resistors in accordance with the invention which will withstand at least 100 surges resulting in an energy density of at least 5000 joules/cm$^3$ per surge.

Figure 3:
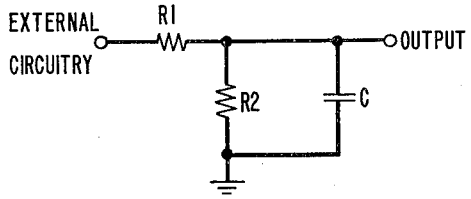
FIG. 3 is a circuit diagram of a voltage divider circuit fabricated in accordance with one embodiment of the invention.

The inventive method was also used to fabricate resistor packages for voltage divider circuits such as that shown in the circuit diagram of FIG. 3. Such thick film circuit packages typically include a row of 300 kΩ resistors, each matched with a resistor in a row of 56 kΩ resistors. As shown in FIG. 3, the matched pairs of resistors ($R_1$ and $R_2$) are each interconnected with a capacitor (C) to form a voltage divider circuit. The 300 kΩ resistor ($R_1$) will be subject to a high voltage spike from the indicated external circuit, while the 56 KΩ resistor ($R_2$) will not be due to the bypass provided by the capacitor. Typically, the external circuit will apply a working voltage of 25–200 volts to such a voltage divider, and high voltage spikes may range from 400–100 volts in amplitude with pulse widths of 200–300 μsec in this application. Since it is important that the ratio of resistances of the matched pair remain within tight tolerances, the use of the present invention in fabricating the 300 kΩ resistors is particularly advantageous.

Conductors were deposited and fired as previously described. The 300 kΩ resistors were deposited with a length of approximately 225 mils, a width of approximately 65 mils and a thickness of approximately one-half mil. The resistors were fired as previously described and typically had a resistance of approximately 225 kΩ. In order to bring the resistance within ±10 percent of the desired value of 300 kΩ, a laser cut was made as before in the direction of the current path to form a current-carrying portion having a width of approximately 49 mils. A cut was then made in the waste portion in a direction perpendicular to the first cut to isolate the waste portion. The other set of resistors in the pair was prepared by the prior art trimming technique since they are not subject to high voltage surges. The final values of these resistors were adjusted so that the ratios of the resistances of all matched pairs were within ±1.5% of nominal.

It will, of course, be understood that dimensions given in these examples are illustrative and will vary depending upon the desired final resistance and the degree of trimming required.

In order for the ratio of resistances of the matched pair to remain within desired limits, it is desirable that the resistors produced in accordance with the invention withstand at least 10,000 voltage spikes of at least 1,000 volts with a variation in resistance no greater than 0.05 percent. Five such circuits were fabricated with the 300 kΩ resistors trimmed utilizing the trimming technique in accordance with one aspect of the invention and were compared with five circuits where the 300 kΩ resistors were trimmed by the prior art technique. Both sets were exposed to 10,000 standard test pulses of rectangular wave shape with a duration of 240 microseconds and an amplitude of 1000 volts. The median change in ratios of the matched resistors prepared in accordance with the invention was 0.02 percent, while the median change for resistors trimmed in accordance with standard techniques was 0.09 percent. Thus, use of the invention results in significant increases in yield of voltage divider circuits. In general, it is desirable to produce resistors in accordance with the invention which will withstand an electric field of at least 1700 volts/cm.

It should also be realized that the invention may be used advantageously in the fabrication of small resistors, i.e., those having a width of approximately 15 mils or less. Such small size resistors cannot be made practically with present trimming techniques due to the very narrow portion which would remain for current conduction in the vicinity of the cut and the attendant problems of current crowding and aging previously discussed. However, small, precisely trimmed resistors are now possible with the trim cut geometry of the present invention.

Further, use of the invention should result generally in resistors having more stable resistance characteristics regardless of their size or whether they are exposed to high voltages or currents. Therefore, it may be possible utilizing this technique to trim resistors in general to a very tight tolerance, typically to within ±0.1 percent of the desired final value.

As mentioned previously, the invention may also be used to fabricate thin film resistors. As known in the art, such resistors arre typically formed by evaporation or sputtering of a material such as tantalum nitride on the substrate, with the geometry defined by photolithography. The thickness of the resistors is typically 100–500 Å. The conductors are usually a multilayer of Ti-Pd-Au or Ti-Cu-Ni-Au formed by a combination of evaporation or sputtering and electroplating. (For more details on fabrication of thin film resistors circuits, see U.S. Pat. No. 4,016,050 issued to Lesh et al. which is incorporated by reference herein.) Instead of using prior art techniques, trimming of the resistors can proceed as previously described with an appropriate adjustment of laser amplitude to account for the smaller thickness.

It will be understood that in the context of this application the designation "rectangular" is meant to include square geometries.

Various additional modifications will become apparent to those skilled in the art. All such variations which basically rely on the teachings through which the invention has advanced the art are properly considered within the spirit and scope of the invention.

We claim:

1. A method for fabricating a resistor circuit comprising the steps of forming on an insulating substrate (21) a rectangular resistor film (20) and a conductive layer including electrodes (22 and 23) which provide electrical contact to said film so as to define a direction for current conduction through said film when a bias is supplied, characterized in that a first cut (24) is made in said film in a direction essentially parallel to the direction of current conduction and extending across the entire distance of the film between electrodes to define a rectangular current-carrying portion (25) with an essentially uniform width having a resistance near a predetermined desired resistance and to define a rectangular waste portion (26), and a second cut (27) is made in said waste portion in a direction essentially perpendicular to said first cut in order to prevent current flow therethrough between the electrodes.

2. The method according to claim 1 wherein the resistor is a thick film resistor.

3. The method according to claim 1 wherein the resistor is a thin film resistor.

4. The method according to claim 1 wherein additional cuts are made in the direction of current conduction to further narrow the current-carrying portion.

5. The method according to claim 1 wherein additional cuts are made in the waste portion in a direction perpendicular to said first cut.

6. The method according to claim 1 wherein the current-carrying portion is capable of withstanding at least 100 current surges resulting in an energy density of at least 5,000 joules/cm$^3$ per surge.

7. The method according to claim 1 wherein the current-carrying portion is capable of withstanding high voltage spikes resulting in an electric field of at least 1700 volts/cm per spike.

8. The method according to claim 1 wherein the first cut is made so as to establish a resistance for the current-carrying portion within 2 percent of the predetermined desired resistance.

9. The method according to claim 1 wherein additional cuts are made in the direction of current conduction to establish a resistance of the current-carrying portion within 0.1 percent of the predetermined desired resistance.

10. The method according to claim 1 wherein the resistor film initially has a width no greater than 15 mils.

11. A method for fabricating a thick film resistor circuit comprising the steps of depositing a conductive layer (22 and 23) selectively on an insulating substrate (21) with a gap of a predetermined length in said layer, depositing a rectangular resistor film (20) on said insulating substrate over said gap and over a portion of said conductive layer, which portion constitutes electrodes which provide electrical contact to said film so as to define a direction for current conduction through said film between the electrodes when a bias is supplied, characterized in that a first laser cut (24) is made in said film in a direction essentially parallel to the direction of current conduction and extending across the entire distance of said film between the electrodes to define a rectangular current-carrying portion (25) with a uniform width and to define a rectangular waste portion (26), and a second laser cut (27) is made in said waste portion in a direction essentially perpendicular to said first cut and extending across the entire width of said waste portion in order to prevent current flow therethrough between the electrodes whereby the current carrying portion is capable of withstanding high current surges.

12. A resistor circuit including a rectangular resistor film (20) and conductive layer (22 and 23) formed on an insulating substrate (21) such that the conductive layer forms electrodes providing electrical contact to said resistor film so as to define a direction for current conduction through said film between the electrodes when a bias is supplied, characterized in that said resistor film includes a first cut (24) in a direction essentially parallel to the direction of current conduction and extending across the entire distance of the film between electrodes so as to define a current-carrying portion (25) with an essentially uniform width having a resistance near a predetermined desired resistance and to define a waste portion (26), and said film further includes a second cut (27) in said waste portion in a direction essentially perpendicular to said first cut so as to prevent current flow therethrough between the electrodes.

13. The circuit according to claim 12 wherein the resistor is a thick film resistor.

14. The circuit according to claim 12 wherein the resistor is a thin film resistor.

15. The circuit according to claim 12 wherein the resistor film includes a plurality of cuts in the direction essentially parallel to the direction of current conduction.

16. The circuit according to claim 12 wherein the waste portion includes a plurality of cuts in the direction essentially perpendicular to the direction of current conduction.

17. The circuit according to claim 12 wherein the current-carrying portion is capable of withstanding at least 100 current surges resulting in an energy density of at least 5,000 joules/$cm^3$ per surge.

18. The circuit according to claim 12 wherein the current-carrying portion is capable of withstanding high voltage spikes resulting in an electric field of at least 1700 volts/cm per spike.

19. A thick film resistor circuit comprising a thick film conductive layer (22 and 23) deposited selectively on an insulating substrate (21) with a gap of a predetermined length in said layer, a thick film rectangular resistor film (20) deposited on said insulating substrate over said gap and over a portion of said conductive layer, which portion constitutes electrodes providing electrical contact to said film so as to define a direction for current conduction through said film between the electrodes when a bias is supplied, characterized in that said resistor film includes a first laser cut (24) therethrough in a direction essentially parallel to the direction of current conduction and extending across the entire distance of said film between the electrodes to define a rectangular current-carrying portion (25) with an essentially uniform width and to define a rectangular waste portion (26), and a second laser cut (27) is included in said waste portion in a direction essentially perpendicular to said first cut and extending across the entire width of said waste portion in order to prevent current flow therethrough between the electrodes whereby the current-carrying portion is capable of withstanding high current surges.

20. A method for fabricating a thick film resistor circuit comprising the steps of depositing a conductive layer (22 and 23) selectively on an insulating substrate (21) with a gap of a predetermined length in said layer, depositing a rectangular resistor film (20) on said insulating substrate over said gap and over a portion of said conductive layer, which portion constitutes electrodes which provide electrical contact to said film so as to define a direction for current conduction through said film between the electrodes when a bias is supplied, characterized in that a first laser cut (24) is made in said film in a direction essentially parallel to the direction of current conduction and extending across the entire distance of said film between the electrodes to define a rectangular current-carrying portion (25) with a uniform width and to define a rectangular waste portion (26), and a second laser cut (27) is made in said waste portion in a direction essentially prependicular to said first cut and extending across the entire width of said waste portion in order to prevent current flow therethrough between the electrodes whereby the current carrying portion is capable of withstanding high voltage spikes.

21. A thick film resistor circuit comprising a thick film conductive layer (22 and 23) deposited selectively on an insulating substrate (21) with a gap of a predetermined length in said layer, a thick film rectangular resistor film (20) deposited on said insulating substrate over said gap and over a portion of said conductive layer, which portion constitutes electrodes providing electrical contact to said film so as to define a direction for current conduction through said film between the electrodes when a bias is supplied, characterized in that said resistor film includes a first laser cut (24) therethrough in a direction essentially parallel to the direction of current conduction and extending across the entire distance of said film between the electrodes to define a rectangular current-carrying portion (25) with an essentially uniform width and to define a rectangular waste portion (26), and a second laser cut (27) is included in said waste portion in a direction essentially perpendicular to said first cut and extending across the entire width of said waste portion in order to prevent current flow therethrough between the electrodes whereby the current-carrying portion is capable of withstanding high voltage spikes.

* * * * *

UNITED STATES PATENT AND TRADEMARK OFFICE

CERTIFICATE OF CORRECTION

PATENT NO. : 4,284,970

DATED : August 18, 1981

INVENTOR(S) : Lloyd Berrin, Howard M. Cohen, William B. Grupen, and James D. McElroy It is certified that error appears in the above—identified patent and that said Letters Patent is hereby corrected as shown below:

Column 1, line 18, "and" should read --as--; line 28, "increased" should read --is increased--; line 37, "again" should read --aging--. Column 3, line 19, "it" should read --It--. Column 4, line 26, "100" should read --1000--.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*